US007101470B2

(12) United States Patent
Stubergh

(10) Patent No.: US 7,101,470 B2
(45) Date of Patent: Sep. 5, 2006

(54) PROCESS FOR PREPARING SILICON BY ELECTROLYSIS AND CRYSTALLIZATION AND PREPARING LOW-ALLOYED AND HIGH-ALLOYED ALUMINUM SILICON ALLOYS

(75) Inventor: Jan Reidar Stubergh, Moss (NO)

(73) Assignee: Norwegian Silicon Refinery AS, Moss (NO)

( * ) Notice: Subject to any disclaimer, the term of this patent is extended or adjusted under 35 U.S.C. 154(b) by 220 days.

(21) Appl. No.: 10/469,049

(22) PCT Filed: Feb. 21, 2002

(86) PCT No.: PCT/NO02/00073

§ 371 (c)(1),
(2), (4) Date: Nov. 5, 2003

(87) PCT Pub. No.: WO02/068719

PCT Pub. Date: Sep. 6, 2002

(65) Prior Publication Data

US 2004/0094428 A1 May 20, 2004

(30) Foreign Application Priority Data

Feb. 26, 2001 (NO) ..... 20010962

(51) Int. Cl.
*C25C 3/36* (2006.01)

(52) U.S. Cl. ..... 205/364

(58) Field of Classification Search ..... 205/364, 205/367, 410

See application file for complete search history.

(56) References Cited

U.S. PATENT DOCUMENTS 3,405,043 A 10/1968 Barakat et al.
5,873,993 A * 2/1999 Stubergh ..... 205/364
5,972,107 A * 10/1999 Schmid et al. ..... 117/79

FOREIGN PATENT DOCUMENTS

JP 2001010893 A * 1/2001
WO 9533870 12/1995
WO 9727143 7/1997

OTHER PUBLICATIONS

Stubergh et al., Preparation of Pure Silicon by Electrowinning in a Bytownite-Cryolite Melt, Dec. 1996, Metallurgical and Materials Transactions B, vol. 27B, 895-900.*
Olson et al., Formation of Aluminum-Silicon Alloys from Feldspars—Determination of Silicon, Light, and Heavy Elements in Silumin by Scanning Electron Microscopy, Aug. 1996, Metallurgical and Materials Transactions B, vol. 27B, 604-609.*
Grjotheim et al, Some aspects of the electrolytic preparation of silicon alloys, 1973, Chem. zvesti., 27 (2), 165-171.*
Abdel-Hamid et al, Preparation of aluminium-silicon alloys and cryolite-aluminium fluoride mixtures from sodium fluosilicate, 1994, Erzmetall, 47, Nr. 9, 528-535.*
Hannah et al, Co-deposition of silicon and aluminium in aluminium reduction cells, 1977, Molten Salt Electrolysis Met. Prod. Int. Symp., Inst. Min. Metall.: London, England, 7-13.*
Stubergh, Processing Silicon, Silumin and Aluminium from Feldspars. —A Method to Regulate the Si, AISi Alloys and AI Amounts by a Continuous Way, Light Metals 1996, pp. 237-241.*
Stubergh, Depostion Silicon and Aluminium-Silicon Alloys from Feldspars, Light Metals 1991, pp. 339-347.*

* cited by examiner

*Primary Examiner*—Roy King
*Assistant Examiner*—Michael P. Alexander
(74) *Attorney, Agent, or Firm*—Wenderoth, Lind & Ponack, L.L.P.

(57) ABSTRACT

A process for preparing highly purified silicon and aluminum and silumin (aluminum silicon alloy) in the same electrolysis furnace, by subjecting silicate and/or quartz containing rocks to electrolysis in a salt melt containing fluoride, whereby silicon and aluminum are formed in an electrolysis bath, and the aluminum formed, which may be low alloyed, flows to the bottom and is drawn off; transferring cathode with deposit to a Si-melting furnace, whereby the deposit with Si on the cathode flows down to the bottom of the melting furnace, and the cathode is removed before melting Si in said furnace, or during the electrolysis, shuffling the deposit formed on the cathode(s) down into the molten electrolysis bath, and transferring the molten or frozen bath containing Si from the cathode deposit to a Si-melting furnace after Al has flowed down to the bottom of the electrolysis furnace and been drawn off; melting the cathode deposit and/or molten or frozen bath, which contain silicon and slag, in the Si-melting furnace; stirring the mixture of silicon and slag intimately, whereafter slag and Si-melt separate directly; removing the slag from the Si-melt; and subjecting the silicon to crystal rectification.

16 Claims, No Drawings

PROCESS FOR PREPARING SILICON BY ELECTROLYSIS AND CRYSTALLIZATION AND PREPARING LOW-ALLOYED AND HIGH-ALLOYED ALUMINUM SILICON ALLOYS

Process for preparing silicon by electrolysis and crystallization, and preparing low-alloyed and high-alloyed aluminum silicon alloys.

The present invention relates to a process for preparing silicon and optionally aluminum and silumin (aluminum silicon alloy) in a salt melt by electrolysis and subsequent refining of the silicon. Silica and silicate rocks and/or aluminum containing silicate rocks are used as raw material, with/without soda ($Na_2CO_3$) and/or limestone ($CaCO_3$) dissolved in fluorides, in particular cryolite.

The products prepared are of high purity.

WO 95/33870 (EP patent 763151), in the following designated as "WO 95", discloses a process for continuous preparation and batch preparation in one or more steps in one or more furnaces, of silicon (Si), optionally silumin (AlSi-alloys) and/or aluminum metal (Al) in a melting bath using feldspar or feldspar containing rocks dissolved in fluoride. In said process Si of high purity is prepared by electrolysis (step I) in a first furnace with a replaceable carbon anode arranged underneath the cathode, and a carbon cathode arranged at the top of the furnace. For the preparation of silumin the silicon-reduced residual electrolyte from step I is transferred to another furnace, and Al is added (step II). Then Al is prepared in a third furnace (step III) by electrolysis after Si has been removed in step I and possibly in step II. It also describes combinations of furnaces with a partition wall in the preparation of the same substances. Further, process equipment for the procedure is described.

The present invention represents a further development and improvement of the above-mentioned process. The greatest improvement is that it is possible to prepare pure Si, pure low-iron low-alloyed Al-alloys (AlSi-alloys) and pure low-phosphorus high-alloyed Al-alloys (SiAl-alloys) in an electrolysis furnace by varying such parameters as the choice of raw material, current density (voltage) and time. The proportions of the Si and Al-products are adjusted by the choice of raw material and cathodic current density (voltage) in the electrolysis bath and mechanical manipulation of the cathodes, Further, the composition of the Al-products varies with the electrolysis time (examples 1 and 2).

A low-alloyed Al-alloy (AlSi-alloy) as referred to herein, is an Al-alloy with an amount of Si which is lower than that of an eutectic mixture (12% Si, 88% Al). Correspondingly, a high-alloyed alloy (SiAl-alloy) as referred to herein is an alloy having a Si-content above that of an eutectic mixture.

According to the present Invention there is provided a process for preparing highly purified silicon and optionally aluminum and silumin (aluminum silicon alloy) in the same cell, wherein Si is transferred directly over to an Si-furnace without any intermediate acid step. The process takes place by I. silicate and/or quartz containing rocks are subjected to electrolysis in a salt melt containing fluoride, whereby silicon and aluminum are formed in an electrolysis bath, and aluminum formed, which may be low alloyed, flows to the bottom and is drawn off, IIa. cathode with deposit is transferred to a Si-melting furnace, the deposit with Si on the cathode melts and flows down to the bottom of the melting furnace, and the cathode is removed before melting Si in said furnace, or IIb. the deposit formed on the cathode(s) is during the electrolysis shuffled down into the molten electrolysis bath, the molten or frozen bath containing Si from the cathode deposit is transferred to a Si-melting furnace after Al has flowed down to the bottom of the electrolysis furnace and been drawn off, III. the cathode deposit and/or molten or frozen bath, which contain silicon and slag, are melted in the Si-melting furnace, IV. the mixture of silicon and slag is stirred intimately, whereafter slag and Si-melt separate directly, V. the slag is removed from the Si-melt, and VI. the silicon Is subjected to crystal rectification.

Soda is added to the electrolysis bath so that said bath will be basic if quartz is used, in order to avoid loss of Si in the form of volatile $SiF_4$. With high concentrations of soda the melting point of the mixture is reduced, and the use of added fluorides goes down. Limestone is added if necessary to reduce the absorption of phosphorus in the Si deposited on the cathode.

The fluorides may be basic or neutral, but are preferably acidic. If it is desired that the fluorides are neutral or acidic, a desired stoichiometric amount of $AlF_3$ is added. The basic fluorides, that are formed by the addition of $Na_2CO_3$ to cryolite (step I), have been analyzed and contain a mixture of cryolite ($Na_3AlF_6$) and a non-stoichiometric composition of $Na_xAl,Si(O,F)_y$. Possibly the fluoride mixture may be added externally and stirred into molten silicon.

EXAMPLE 1 (from WO 95)

A feldspar of the type $CaAl_2Si_2O_8$ containing 50% $SiO_2$, 31% $Al_2O_3$ and 0.8% $Fe_2O_3$, was dissolved in cryolite and electrolyzed with a cathodic current density of 0.05 A/cm$^2$ (U=2.5–3.0 V) for 18.5 hours. In the deposit around the cathode highly purified Si was formed separate from small FeSi-grains. In the electrolyte dissolved $Al_2O_3$ was formed. Al is not formed.

Since Al was not formed in the bath ($Al^{3+}$-containing electrolyte) this was the reason why bath was drawn off from this furnace (step I) and to another furnace (step II) in which residues of Si and Si(IV) were removed by addition of Al before the electrolysis and the preparation of Al in a third furnace (step III). (See WO 95). Conclusion: The reason why only Si and not Al was formed in step I in the present case, was the low current density (voltage).

EXAMPLE 2

Quartz containing close to 99.9% $SiO_2$ was dissolved in cryolite ($Na_3AlF_6$), mixed with 5% soda ($Na_2CO_3$) and electrolyzed with a cathodic current density of 0.5 A/cm$^2$ (U=6–7 V) for 44 hours. In the deposit around the cathode highly purified Si was formed. Most of (12 kg) of the cathode deposit was pushed into the bath (the electrolyte). The remaining cathode deposit (8 kg) was lifted out with the cathodes together with the residues of the anode. The cathode deposit was easily knocked off the cathodes. Both the cathode deposit and the electrolyte in the bath contained 20% Si. Small amounts of Al (low alloyed AlSi-alloy) were formed, which were low in iron and phosphorus. Iron and phosphorus poor AlSi-alloys are defined as <1300 ppm Fe and <8 ppm P. The analysis of Al showed 8% Si and 110 ppm Fe and 0.08 ppm P.

Conclusion: The reason why both Si and Al were formed in step I was the high current density (voltage) A originates from electrolyzed cryolite. The reason why Al (the AlSi-alloy) was now alloyed with Si, was that Si from the cathode deposit has been dissolved in Al. The reason why the Al-alloy is iron and phosphorus poor was that the raw materials initially are low in iron and phosphorus.

In the crystal rectification of silicon a distribution coefficient (segregation coefficient) of 0.35 is expected for phosphorus, as the distribution coefficient for elements is well known. This means that when the Si-powder in the cathode deposit contained 7.2 ppm P, it is expected that with perfect crystal rectification Si should contain 2.5 ppm P. By studying the crystallization in Si it was found that it was not perfect. From this one may draw the conclusion that the P-content should be higher than 2.5. However, the analysis showed that the P-content In Si was 1.0 ppm. The reason why the P-content in Si was so low, is found to be the use of slag containing fluorides, and good stirring of the Si-melt with slag.

If it is desired to prepare Al together with Si, the cathodic current density should be relatively high, at least above 0.05 $A/cm^2$, preferably above 0.1, in particular above 0.2 $A/cm^2$. An upper limit is about 2, preferably about 1.6 $A/cm^2$. In addition to the formation of aluminum with a high current density, the electrolysis rate also increases with increasing cathodic current density.

With electrolysis it was found that the purity of Si was in the range 99.92 –99.99% in the cathode deposit Previously (WO 95), in order to concentrate Si further above 20% from the cathode deposit, the cathode deposit was crushed so that as much as possible of free and partly not free Si-grains would float up and could be taken up on the surface in a heavy liquid consisting of different $C_2H_2Br_4$/acetone mixtures with a density of up to 2.96 $g/cm^3$. Si in solid form has a density of 2.3 $g/cm^3$ and will float up, while solids of cryolite have a density of 3 $g/cm^3$ and will remain at a bottom. After filtration and drying of the powder for removal of heavy liquid, the different concentration fractions were mixed with water/$H_2SO_4$/HCl for refining Si.

In WO 97/27143, in the following designated as "WO 97", water, HCl and $H_2SO_4$ in this order were added to crushed cathode deposit, containing 20% Si, to refine Si with a dilute NaOH, which was formed by adding water. Then it was tried to concentrate the powder containing Si refined with HCl, with concentrated $H_2SO_4$.

Neither in WO 95 nor in WO 97 was Si concentrated more than to about 40%. The reason for this is that the fluorooxo-silicate complexes in the cathode deposit were hydrolyzed in water and NaOH to form a difficultly soluble hydrated silica. As a consequence of this an addition of $H_2SO_4$ after the treatment with water did not result in the desired concentration effect. Concentrated HCl does not have any essential concentrating effect as it contains much water. In WO 97 a jig was used to concentrate Si further. This resulted only in an insignificant concentration.

When it is primarily desired to prepare Si, a quartz containing rock is suitably used as starting material. If Al is also of interest, a rock containing an Al-rich feldspar, for instance anorthite ($CaAl_2Si_2O_8$) is suitably used.

After cathode deposit, molten and frozen bath from the electrolysis (point I) has been brought over into the Si-furnace, said furnace is heated above the melting point of Si (about 1420° C.), and the basic, neutral or acidic (adjusted by addition of $AlF_3$) mixture of electrolyte (slag) is stirred intimately into the Si-melt so that said melt gradually reacts with the contaminations in the Si-melt and removes these The Si-grains, which are partly embedded in electrolyte, have melted together to a homogenous mass. Molten Si has a density (d=2.5 $g/cm^3$) and sinks to the bottom of the furnace. The refining of the Si-grains takes place in this novel melting step, due to the addition of electrolyte to the Si-melt and due to a subsequent crystal rectification. Solidified Si is in this case purer than if fluoride-containing slag have not been present.

Solidified Si from the melting step may be melted together with Al prepared in the electrolysis, to form Fe-poor, P-poor, low-alloyed AlSi-alloys and/or high-alloyed SiAl-alloys, which are desired alloys in many connections.

Both the high alloyed SiAl-alloys and the low-alloyed AlSi-alloys may be dissolved in HCl or $H_2SO_4$. Al goes into solution and "pure"-Si-powder (~100% and free from electrolyte) is formed. From dissolved Al pure products of $AlCl_3$ and $Al_2(SO_4)_3$ are formed.

With respect to equipment it is suitable that the walls consisting of graphite in the electrolysis furnace advantageously can be replaced by SiC or silicon nitride-bound SiC.

The walls of the electrolysis furnace do not have to consist of Si (WO 95, FIG. 2 number 4). Further, Si does not have to cover the anode stem, since a current jump does not take place between the cathode and anode even when they grow together.

The invention claimed is:

1. A process for preparing highly purified silicon and aluminum and silumin (aluminum silicon alloy) in the same electrolysis furnace, which comprises I. subjecting silicate and/or quartz containing rocks to electrolysis in a salt melt containing fluoride, whereby silicon and aluminum are formed in an electrolysis bath, and the aluminum formed, which may be low alloyed, flows to the bottom and is drawn off, IIa. transferring cathode with deposit to a Si-melting furnace, whereby the deposit with Si on the cathode flows down to the bottom of the melting furnace, and the cathode is removed before melting Si in said furnace, or IIb. during the electrolysis, shuffling the deposit formed on the cathode(s) down into the molten electrolysis bath, and transferring the molten or frozen bath containing Si from the cathode deposit to a Si-melting furnace after Al has flowed down to the bottom of the electrolysis furnace and been drawn off, III. melting the cathode deposit and/or molten or frozen bath, which contain silicon and slag, in the Si-melting furnace, IV. stirring the mixture of silicon and slag intimately, whereafter slag and Si-melt separate directly, V. removing the slag from the Si-melt, and VI. subjecting the silicon to crystal rectification.

2. Process according to claim 1, wherein the fluoride-containing electrolysis bath contains cryolite.

3. Process according to claim 1, wherein soda ($Na_2CO_3$) and limestone ($CaCO_3$) are used in the electrolysis bath.

4. The process according to claim 1, wherein quartz containing rocks are used as starting material for the preparation of Si.

5. The process according to claim 1, wherein a rock containing aluminum rich feldspar ($CaAl_2Si_2O_8$) is used for the preparation of both aluminum and silicon.

6. The process according to claim 1, wherein the slag is a basic, neutral or acidic fluoride-containing electrolyte which is mixed with the molten silicon; slag and silicon are separated; and the silicon is crystallized.

7. The process according to claim 6, wherein the slag is the acidic fluoride-containing electrolyte.

8. The process according to claim 2, wherein soda ($Na_2CO_3$) and limestone ($CaCO_3$) are used in the electrolysis bath.

9. The process according to claim 2, wherein quartz containing rocks are used as starting material for the preparation of Si.

10. The process according to claim 3, wherein quartz containing rocks are used as starting material for the preparation of Si.

11. The process according to claim 2, wherein a rock containing aluminum rich feldspar ($CaAl_2Si_2O_8$) is used for the preparation of both aluminum and silicon.

12. The process according to claim 3, wherein a rock containing aluminum rich feldspar ($CaAl_2Si_2O_8$) is used for the preparation of both aluminum and silicon.

13. The process according to claim 2, wherein the slag is a basic, neutral or acidic fluoride-containing electrolyte which is mixed with the molten silicon; slag and silicon are separated; and the silicon is crystallized.

14. The process according to claim 3, wherein the slag is a basic, neutral or acidic fluoride-containing electrolyte which is mixed with the molten silicon; slag and silicon are separated; and the silicon is crystallized.

15. The process according to claim 4, wherein the slag is a basic, neutral or acidic fluoride-containing electrolyte which is mixed with the molten silicon; slag and silicon are separated; and the silicon is crystallized.

16. The process according to claim 5, wherein the slag is a basic, neutral or acidic fluoride-containing electrolyte which is mixed with the molten silicon; slag and silicon are separated; and the silicon is crystallized.

* * * * *